United States Patent [19]

Dorsch

[11] 4,084,565

[45] Apr. 18, 1978

[54] COMBUSTION AIR SUPPLY APPARATUS FOR AN INTERNAL COMBUSTION ENGINE

[75] Inventor: Heinz Dorsch, Weissach-Flacht, Germany

[73] Assignee: Dr. Ing. h.c.F. Porsche Aktiengesellschaft, Germany

[21] Appl. No.: 719,706

[22] Filed: Sep. 2, 1976

[30] Foreign Application Priority Data

Sep. 2, 1975 Germany ..... 2538921

[51] Int. Cl.[2] ..... F02D 1/04; F02M 7/00

[52] U.S. Cl. ..... 123/140 MP; 123/119 D; 123/119 DB

[58] Field of Search ..... 123/139 AW, 119 DB, 123/140 MP, 124 R, 119 D

[56] References Cited

U.S. PATENT DOCUMENTS

| | | | |
|---|---|---|---|
| 2,865,356 | 12/1958 | Groezinger | 123/140 MP |
| 2,884,918 | 5/1959 | Klug | 123/140 MP |
| 2,893,367 | 7/1959 | Druzynski | 123/140 MP |
| 2,899,952 | 8/1959 | Zechnall et al. | 123/140 MP |
| 3,698,371 | 10/1972 | Mitsuyama | 123/119 DB |
| 3,823,699 | 7/1974 | Adair | 123/119 DB |
| 3,850,154 | 11/1974 | Chahopadhayay | 123/140 MP |

*Primary Examiner*—Ronald B. Cox
*Attorney, Agent, or Firm*—Craig & Antonelli

[57] ABSTRACT

An improved combustion air supply apparatus is provided for an internal combustion engine. An air supply line for supplying combustion air to the engine is provided with a load regulating throttle valve disposed therein. In by-passing relationship to the throttle valve, a by-pass line and supplementary air valve control mechanism is provided for controlling flow of additional air in by-passing relationship to the throttle valve as a function of the suction pressure in said air supply line downstream of the throttle valve.

7 Claims, 3 Drawing Figures

COMBUSTION AIR SUPPLY APPARATUS FOR AN INTERNAL COMBUSTION ENGINE

BACKGROUND AND SUMMARY OF THE INVENTION

The invention relates to internal combustion engines, and more specifically, to an improved air supply arrangement for such engines. According to the invention, a by-pass line is provided which by-passes the load-regulating member or throttle valve in the main air supply line. For example, the arrangement of the invention could be used with an internal combustion engine of the type with an air measuring, independent drive fuel injection installation being supplied continuously with fuel.

Internal combustion engines with the above-noted type of injection installation are known (Bosch, Technical Instruction Gasoline Injection K-Jetronic, 1st issue February, 1974) in which, during the warm-operation phase of the engine, a larger quantity of fuel-air mixture is supplied and corresponds to the position of the load-regulating member, in order to compensate for the increased friction work of the internal combustion engine during such phase of operation. This is attained through a supplementary air slide-valve, by-passing the load-regulating member. The cross section of the supplementary air slide valve by an apertured partition controlled in dependence of the heating of an electrically heated bi-metal strip, which, during a warm operating condition of the internal combustion engine, is closed. However, this arrangement exhibits disadvantages with respect to engine starting conditions, since the additional quantity of fuel and air mixture provided during the warm-operating phase after the starting process is not always sufficiently large during the starting process, whereby, among other things, a positive start and a rapid acceleration of the internal combustion of the idling speed (no load speed) is not assured.

The present invention contemplates providing apparatus which overcomes the above-mentioned disadvantages and which optimizes the starting and warm-operation phases of an internal combustion engine of the kind mentioned above.

More specifically, the present invention contemplates the provision of a by-pass line with a supplementary air control valve controlled in dependence on the engine suction pipe vacuum. According to one preferred embodiment of the invention, a supplementary air valve is provided which has a valve disk connected with a membrane moveable therewith to open and close the by-pass line. The pressure in the main air supply line or suction pipe upstream of the throttle valve acts on one side of the membrane and, via a control line, the suction pipe pressure downstream of the throttle valve acts at the other side of the membrane. A compression spring is arranged at the site of the membrane acted upon by the suction pipe vacuum.

A further preferred embodiment of the invention includes a supplementary air valve in a housing. A valve disk, combined with a membrane, is arranged in the housing for opening and closing the by-pass line. Atmospheric pressure acts, by means of an opening in the housing, on one side of the membrane facing away from the valve disk. The suction pipe vacuum pressure downstream of the throttle valve acts on the other side of the membrane. Between the housing and the valve disk a compression spring is arranged. A separation sheet metal is arranged between the membrane and the valve disk in the housing, and this separation is provided with a throttle opening for influencing the opening and closing velocity of the valve disk in an advantageous manner.

The constructions of the present invention exhibit advantages, especially, during the start of the internal combustion engine and the rapid acceleration to the no load rotative speed, during which phases the exhaust emission of the internal combustion engine is diminished. In addition, the operation of the driver pedal during the starting process with the use of the supplementary air valve in accordance with the present invention is unnecessary. Also, by means of the supplementary air valve of the invention during start of driving, stalling of the internal combustion engine is effectively avoided since, with a too small operation of the driver pedal, the suction pipe vacuum immediately becomes so small that, by means of the supplementary air valve, the quantity of fuel-air mixture supplied to the internal combustion engine is immediately increased.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
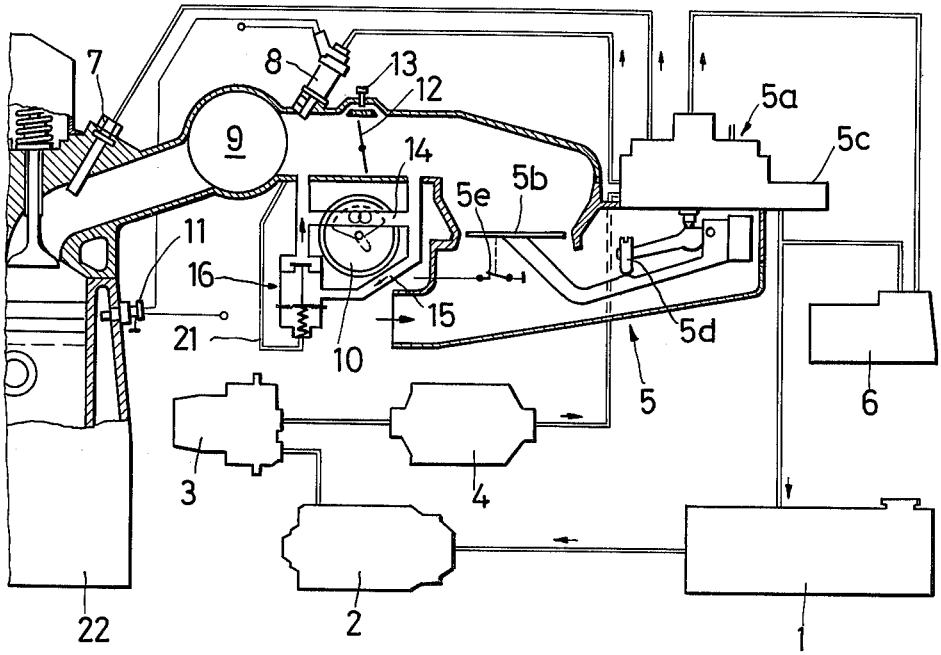
FIG. 1 is a schematic view which shows a supplementary air valve arrangement constructed in accordance with the present invention in conjunction with an internal combustion engine.
Figure 2:
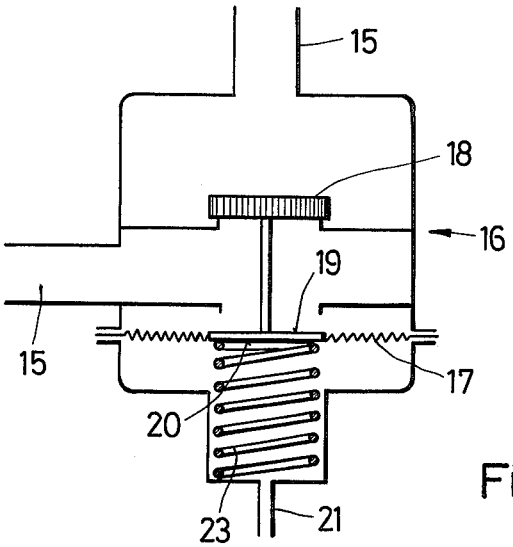
FIG. 2 is an enlarged view which shows the supplementary air valve according to the embodiment of FIG. 1.

Throughout the various drawing figures, like reference numerals are used to designate like structure.

Referring to FIG. 1 of the drawings, a fuel tank 1 is provided from which fuel is supplied by an electo-fuel pump 2 via a fuel storer 3 and a fuel filter 4 to a mixture regulator 5. The mixture regulator 5 is provided with a fuel quantity divider 5*a*, an air quantity measuring device 5*b*, a system-pressure regulator 5*c*, a mixture regulating screw 5*d* and an air quantity measuring contact 5*e*. A warm-operation regulator 6, an injection valve 7, an electro-starting valve 8, a collecting suction pipe 9, a supplementary air slide valve 10, a thermo-time switch 11, a load-regulating throttle valve 12, and a no-load adjusting screw 13 are also provided as illustrated in FIG. 1. The supplementary air slide valve 10 is arranged in a by-pass line 14 which by-passes the load-regulating throttle valve 12. A further by-pass line, skirting both the load-regulating throttle 12 and the supplementary air slide valve 10 is designated as 15. A supplementary air valve 16 is arranged in this by-pass line 15.

The supplementary air valve 16 is provided with a membrane 17 connected with a valve disk 18 which opens and closes the by-pass line 15. The suction pressure acts on the side 19 of membrane 17 via a by-pass line 15 ahead or upstream of the load regulating throttle member 12, while the suction pipe vacuum pressure downstream of member 12 acts on side 20 of the membrane by way of control line 21. A compression spring 23 is arranged at the side 20 of the membrane 17 acted upon by the suction pipe vacuum.

The internal combustion engine combustion chamber, inlet, piston and cylinders are only schematically depicted at 22 in FIG. 1.

The mode of operation of the invention is as follows. The injection installation shown is a mechanical, continuously operating injection system for Otto type engines which does not require direct driving from the internal combustion engine. The fuel is delivered by an electrically driven roller cell pump 2. The air quantity sucked in by the internal combustion engine during operation is measured by an air quantity measuring device **5*b* which is installed upstream of the load-regulating member 12 of the engine 22. According to the position of the load-regulating member 12, respectively the driver pedal, more or less air is sucked in. Corresponding to the measured air quantity, the fuel quantity divider 5*a* apportions a fuel quantity to the individual cylinders of the internal combustion engine 22 via the associated injection valve 7, which results in an optimal mixture regarding internal combustion engine output, fuel consumption, and exhaust composition. The air quantity measuring device 5*b* and the fuel-quantity divider 5*a* are combined in one apparatus, namely the mixture regulator 5. The accurately measured fuel quantity is delivered to the injection valves 7 which spray the fuel in finely vaporized form continuously into the suction pipe ahead of the inlet valves of the cylinders of the internal combustion engine 22. From there, the fuel is sucked together with the air into the internal combustion engine cylinders during opening of the inlet valves. In preferred embodiments, a correction unit is available for the injection installation for the warm-operating phase of the internal combustion engine (see reference numeral 6 of FIG. 1**).

During the warm-operating phase of an internal combustion engine, essentially two corrections are required in relation to the operating-warm condition, namely:

1. Compensation or equalization of the condensation losses at the cold combustion chamber and at the suction pipe walls.

2. Compensation for the increased friction load.

The condensation losses are equalized by a richer mixture. This problem is taken over by the warm-operation regulator 6 in a manner not further discussed herein, since the detailed operation thereof is unnecessary to an understanding of the present invention.

The increased friction work is equalized by the supply of a larger quantity of the fuel-air mixture than corresponds to the position of the load-regulating member 12. This is obtained by by-passing the load-regulator member 12 by means of a supplementary air slide valve 10. The cross section of slide valve 10 is controlled by an apertured partition, that is, dependent on the warming-up of an electrically heated bi-metal strip. In the operating-warm condition, the supplementary cross section is closed.

During the starting process of the internal combustion engine (about 50 to 100 RPM), the suction pipe vacuum behind the load regulating member 12 is so small that the force of the compression spring 23, acting on the valve disk 18 and membrane 17, opens the by-pass line 15 so that air is supplied to the internal combustion engine 22 via the load-regulating member 12, the supplementary slide valve 10, and the supplementary air valve 16. The internal combustion engine 22 operates up to a rotative speed of about 1,000 RPM so that the suction pipe vacuum behind the load-regulating member 12 increases. Via the control line 21, this increased suction pipe vacuum causes a closing of the by-pass line 15 by means of the valve disk 18 so that the internal combustion engine 22 is supplied with air in the further warm-operation phase only through the load-regulating member 12 and the supplementary air slide valve 10.

Figure 3:
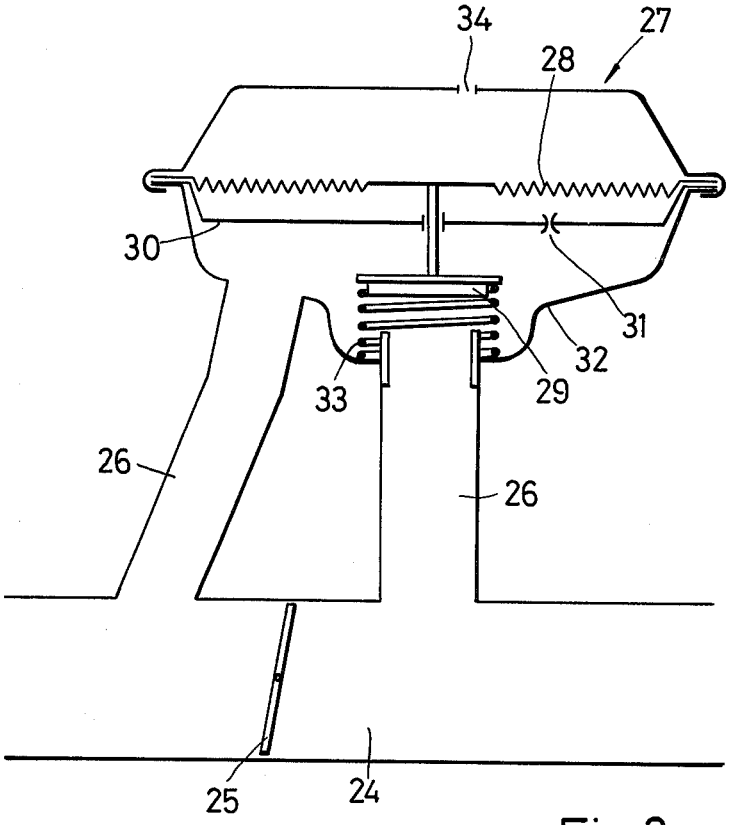
FIG. 3 is an enlarged view showing a further exemplified embodiment of a supplementary air valve constructed in accordance with the present invention.

In the FIG. 3 embodiment of the invention, the suction pipe of the internal combustion engine is designated as 24, within which is arranged a load-regulating throttle valve member 25. A by-pass line 26, by-passing the load-regulating member 25, is arranged in conjunction with supplementary air valve 27. This supplementary air valve 27 is provided with a valve disk 29, connected to a membrane 28, which opens of closes the by-pass line 26. Inside the supplementary air valve 27, a separation sheet metal 30 is arranged between the membrane 28 and the valve disk 29, within which sheet metal separation a throttle opening 31 is provided. A compression spring 33 is arranged between the side of the valve disk 29 facing away from the membrane 28 and the housing 32 of the supplementary air valve 27. Housing 32 of the supplementary air valve 27 is provided with an opening 34 leading to the atmosphere at the side of the membrane 28 facing away from the valve disk 29.

The mode of operation of the supplementary air valve 27 is as follows. During the starting process of the internal combustion engine, the suction pipe vacuum behind the load-regulating member 25 is so small, that the force of the compression spring 33, acting on the valve disk 29, opens the by-pass line 26 so as to supply air to the internal combustion engine via both the load-regulating member 25 and the supplementary air valve 27. The internal combustion engine runs at high speed and the suction pipe vacuum increases. This suction pipe vacuum becomes effective at the membrane 28 and causes a closing of the by-pass line 26 by means of the valve disk 29, against the force of the compression spring 33, so that only the load-regulating member 24 supplies air to the internal combustion engine. The opening and closing velocity of the valve disk 29 is advantageously controlled by controlling the size of the throttle opening in separation sheet 30 since, by this measure, the effectiveness of the suction pipe vacuum on the membrane 28 can be influenced.

The present invention is not restricted to the specifically shown exemplified embodiments. For example, the inventive supplementary air valve 16 could be utilized also for internal combustion engines with other fuel-air mixture supplying devices such as, for example, mechanical injection pumps with suction pipe injection or electronic injection systems.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

What is claimed is:

1. An internal combustion engine comprising:

an air supply line for supplying combustion air to combustion chamber means of said engine, a load regulating member disposed in said air supply line for controlling the flow of combustion air therethrough, a by-pass line extending in by-passing relationship to said load regulating member from a position upstream of said load regulating member to a position downstream thereof, a supplementary air valve disposed in said by-pass line for controlling the flow of combustion air therethrough, and supplementary air valve control means for controlling said supplementary air valve as a function of the suction pressure in said air supply line of a position downstream of said load regulating member, wherein said supplementary air valve includes:

a housing, a valve means for controlling the opening of said by-pass line in dependence on its position, a membrane connected to and moveable with the valve disk, atmosphere opening means in said housing for communicating atmospheric air to one side of said membrane, means for communicating the suction pressure in said air supply line to the other side of said membrane, and spring means engaged between the housing and the valve means, and wherein a separation wall is arranged in the housing between the membrane and the valve means, and wherein a throttle opening is provided in said separation wall.

2. An engine according to claim 1, wherein said regulating member is a throttle flap valve.

3. An engine according to claim 2, wherein said engine includes an air measure responsive independently driven injection installation with continuous fuel supply thereto.

4. An engine according to claim 1, wherein said supplementary air valve includes:

a housing, a valve disk for controlling the opening of said by-pass line in dependence on its position, a membrane connected to and moveable with the valve disk, atmosphere opening means in said housing for communicating atmospheric air to one side of said membrane, means for communicating the suction pressure in said air supply line to the other side of said membrane, and spring means engaged between the housing and the valve disk.

5. An engine according to claim 1, wherein said spring means is a compression spring.

6. An engine according to claim 1, further comprising a temperature responsive air slide valve which is in by-passing relationship to both the load regulating member and the supplementary air valve.

7. An engine according to claim 3, further comprising a temperature responsive air slide valve which is in by-passing relationship to both the load regulating member and the supplementary air valve.

* * * * *